United States Patent [19]

Tapdrup

[11] Patent Number: 4,846,750

[45] Date of Patent: Jul. 11, 1989

[54] BUILDING BASE FOR A TOY BUILDING SET

[75] Inventor: Erik P. Tapdrup, Virum, Denmark

[73] Assignee: Interlego A.G., Baar, Switzerland

[21] Appl. No.: 882,934

[22] PCT Filed: Nov. 29, 1985

[86] PCT No.: PCT/DK85/00112

§ 371 Date: Jun. 27, 1986

§ 102(e) Date: Jun. 27, 1986

[87] PCT Pub. No.: WO86/03133

PCT Pub. Date: Jun. 5, 1986

[30] Foreign Application Priority Data

Nov. 30, 1984 [DK] Denmark ..... 5705/84

[51] Int. Cl.[4] ..... A63H 33/08

[52] U.S. Cl. ..... 446/128; 446/97; 446/118

[58] Field of Search ..... 446/1, 85, 97, 128, 446/118; 273/276, 282, 287; 434/195, 259; 220/23.4, 23.86, 23.83; 206/570

[56] References Cited

U.S. PATENT DOCUMENTS

| | | | |
|---|---|---|---|
| 3,326,557 | 6/1967 | Berendt | 446/85 X |
| 3,365,198 | 1/1968 | Hay . | |
| 3,414,986 | 12/1968 | Stussen | 434/195 |
| 3,422,563 | 1/1969 | Kiley . | |
| 3,635,361 | 1/1972 | Hayes | 206/510 |
| 3,767,203 | 10/1973 | Eaker . | |
| 4,052,074 | 10/1977 | Fogle et al. . | |
| 4,133,538 | 1/1979 | Ambrose | 273/276 |
| 4,205,482 | 6/1980 | Christiansen et al. | 446/128 X |
| 4,487,585 | 12/1984 | Goldwasser | 434/259 |
| 4,518,359 | 5/1985 | Yao-Psong | 434/195 |
| 4,547,160 | 10/1985 | Labelle | 434/195 |

FOREIGN PATENT DOCUMENTS

| | | | |
|---|---|---|---|
| 129080 | 8/1974 | Denmark . | |
| 143175 | 7/1981 | Denmark . | |
| 1108600 | 6/1961 | Fed. Rep. of Germany . | |
| 54259 | 11/1967 | Fed. Rep. of Germany | 446/128 |
| 339188 | 9/1971 | Sweden . | |
| 2120108A | 11/1983 | United Kingdom . | |

*Primary Examiner*—James R. Brittain

*Attorney, Agent, or Firm*—Kane, Dalsimer, Sullivan, Kurucz, Levy, Eisele, and Richard

[57] ABSTRACT

A base for a building set is provided on one side with coupling studs for mounting building blocks having corresponding coupling elements. The base is further provided with cavities contoured to receive at least some of the building blocks. The cavities preferably extend from the side opposite the side provided with the coupling studs.

5 Claims, 3 Drawing Sheets

FIG. 1
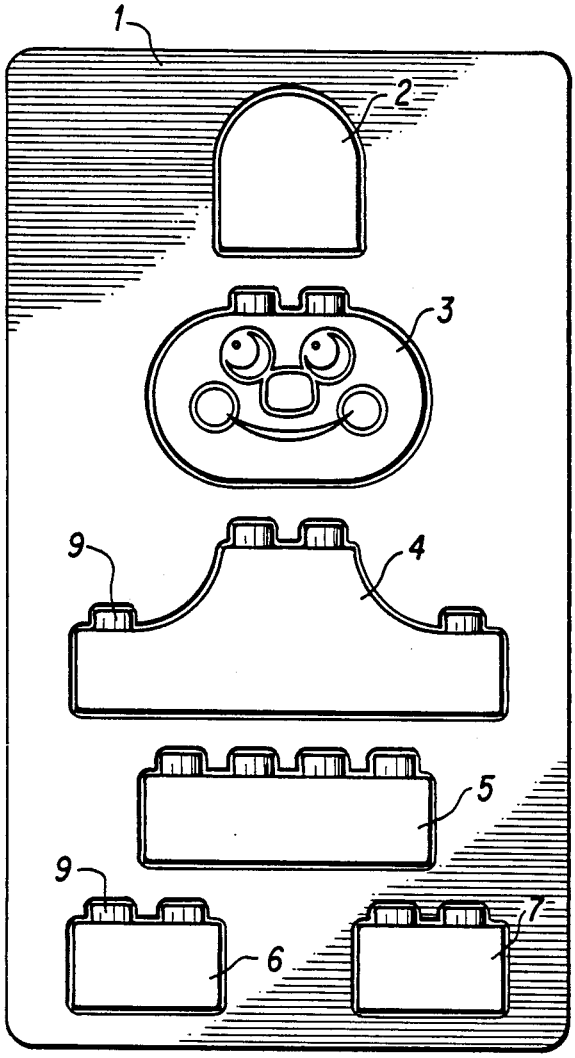
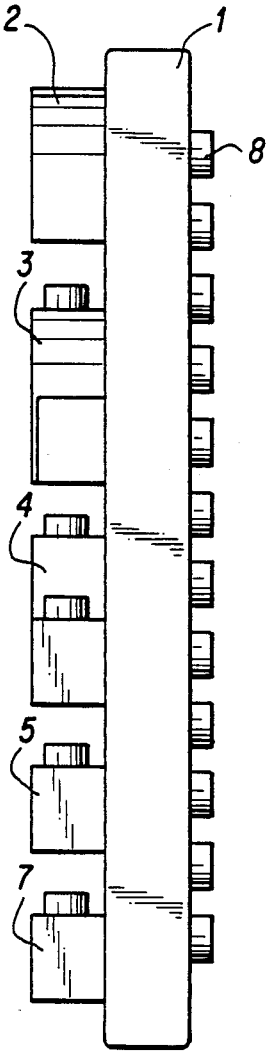
FIG. 2
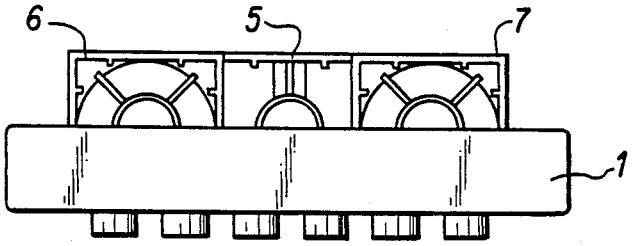
FIG. 3

BUILDING BASE FOR A TOY BUILDING SET

The invention concerns a building base for a toy building set comprising building elements with coupling means for mutual mechanical joining of the building elements, said building base having one side provided with a plurality of coupling means serving to cooperate with said coupling means. Such a building base is commercially available as an ordinary plane plate whose one side is provided with coupling studs designed to cooperate with the coupling means on some associated building blocks.

This building set requires the child to have a suitable age in order for it be able to joint the buiding elements, and even the simplest coupling means on the building elements require a certain age.

The object of the invention is to provide a building base for a toy building set, said building base being so designed that, in connection with the associated building blocks, it presents educational and inspiring play possibilities for children whose faculties are not yet developed sufficiently for them to be able to utilize the said coupling means on the building blocks and the building base.

This object is achieved in that the building base is so shaped that another of the building base sides has a plurality of cavities with predetermined contours, and that the building set comprises elements with different outer contours corresponding to at least the said predetermined contours. Then, the child can at a very early stage recognize contours and place the building blocks in the respective, correct cavities. When the child has acquired this skill, the child can by itself, using its own imagination or through possible assistance, advance to using the more complicated coupling means precisely at the educationally correct time when the child "has become tired of" the contour toy and needs further challenges. Thus, the building base of the invention provides a toy which is an ideal educational toy and is also useful over a greater span of time than was the case in the past.

The building base of the invention may be shaped as a spatial figure, e.g. box-shaped or tetrahedral, but, preferably, the building base is shaped as a plane plate, as appears from claim 2. The cavities might be defined by some walls protruding from one of the building base sides, but the cavities are preferably defined by depressions in the building base, as stated in claim 3.

The coupling means of the building blocks may be of any type, and in a preferred embodiment the coupling means are formed as stated in claim 4, the sides mentioned in claim 4 being preferably perpendicular to the contour of the building block. With reference to the coupling means mentioned in claim 4, the coupling means on the building base might consist of the said, corresponding cavities, but the building base is preferably provided with coupling studs, as stated in claim 5.

Figure 4:
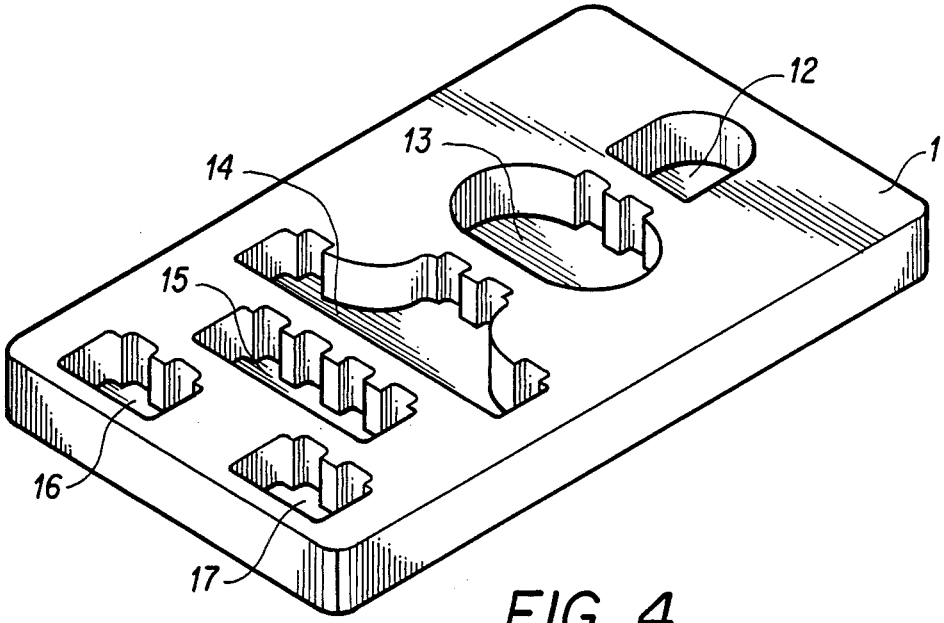
Figure 5:
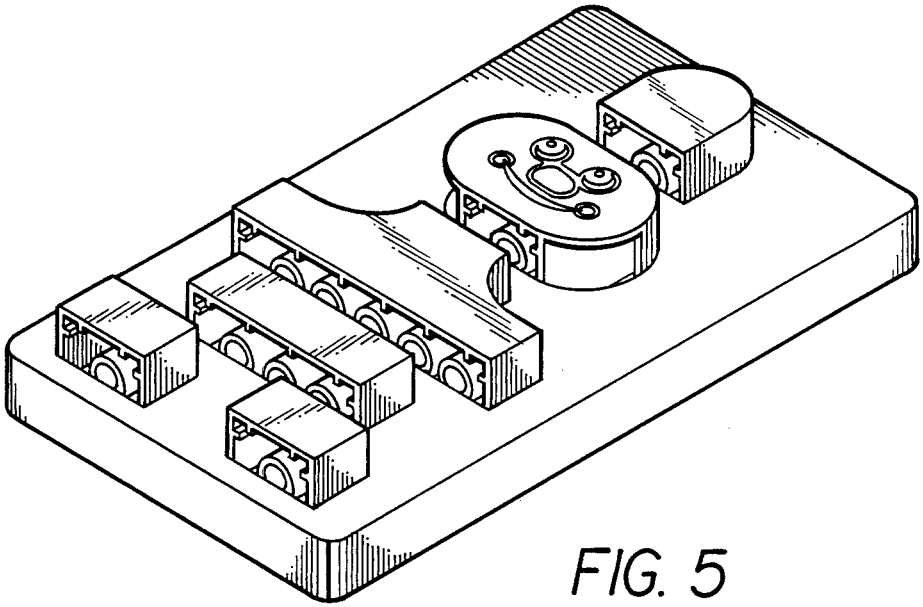
Figure 6:
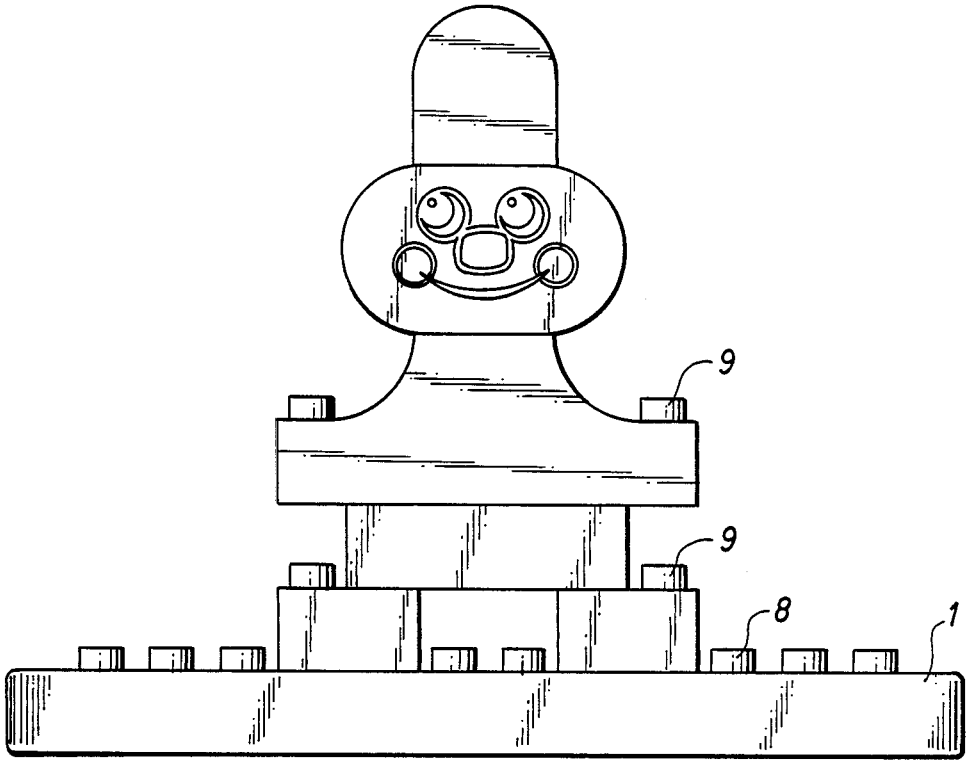

The invention will be explained more fully by the following description of a preferred embodiment, with reference to the drawing, in which FIG. 1 shows an embodiment of the invention, showing a building plate and six associated building blocks, FIGS. 2 and 3 are side and end views, respectively, of the toy building set of FIG. 1, FIGS. 4 and 5 show the building base without and with, respectively, the building blocks in their associated cavities, while FIG. 6 shows an example of the joining of the building elements, in which the building base of the invention serves as a base plate for the building blocks.

FIG. 1 shows a building plate 1 comprising cavities, as explained later, to receive building blocks 2–7. As appears from the drawing, these building blocks are each formed with a special contour, symbolizing a hat, a head, an upper part of the body, a lower part of the body, and two legs, respectively, for a human-like figure, cf. FIG. 6.

FIG. 4 shows clearly the cavities 12–17 shaped as depressions in the plate 1 to receive the building blocks 2–7, respectively. FIG. 5 shows the building plate in which the building blocks are correctly placed, and this situation is shown in FIGS. 2 and 3, directly from the side and from the end, respectively. It can be seen from FIGS. 2 and 3 that the opposite side of the building plate 1 is provided with coupling studs, twelve such coupling studs being provided on the long side and six such coupling studs on the short side, so that the building plate comprises a total of 72 such coupling studs. These coupling studs are designed to cooperate with complementary coupling means on the underside of the building blocks, which can be seen in FIGS. 3 and 5, where the walls shown in FIG. 3 fit snugly around the coupling studs 8 so that the building blocks can be placed on the coupling studs 8. Also the building blocks themselves are provided with coupling studs 9, and these, too, are designed to be received snugly between some walls in the base of the building blocks so that the building blocks 2–7 can be joined together, e.g. to the human-like figure shown in FIG. 6.

As appears already from the preamble to the description, a structure like the one shown in FIG. 6 is generally known, but requires the child to have a sufficient age for it to be able to join the building blocks together. The building base of the invention, in particular the embodiment shown in FIGS. 1–6, provides the advantage that the child at a somewhat younger age can utilize the toy to develop its imagination and faculty of combination, and later on the child finds new challenges by means of its well-known toy in trying to joing the building blocks in the manner shown in FIG. 6, or in other, more advanced ways since the building set can conceivably be completed with an additional number of building blocks which can be joined with the described building blocks.

I claim:

1. In combination a building base for a toy building set and a plurality of building elements, said building elements being provided with coupling means arranged at a mutual distance, which is a multiple of a modular distance common to all the coupling means for mutual mechanical joining of the building elements in an elective manner in a variety of ways as defined by said modulator distance and at least some of the building elements having different outer contours, said building base having one side provided with a plurality of coupling means arranged at a mutual distance, which is a multiple of said modular distance, adapted to engage with the building element coupling means and another side provided with cavities extending therein, each of said cavities having a contour corresponding to at least the outer contour of one of the building elements.

2. The invention in accordance with claim 1 wherein the building base is a plane plate.

3. The invention in accordance with claim 2 wherein the cavities are in the form of depressions extending from said another side of the plate, the depth of said depressions being smaller than the thickness of the plate.

4. The invention in accordance with claim 3 wherein the coupling means of each of said building elements comprises projecting coupling studs and counter coupling cavities respectively positioned on opposite sides of said building elements.

5. The invention in accordance with claim 4 wherein the coupling means on the one side of the building base comprises projecting coupling studs.

* * * * *